United States Patent [19]

Pinto

[11] Patent Number: 4,520,530

[45] Date of Patent: Jun. 4, 1985

[54] FIBER FEEDING APPARATUS WITH A PIVOTED AIR EXHAUST WALL PORTION

[76] Inventor: Akiva Pinto, 525 Eastwood Dr., Gastonia, N.C. 20854

[21] Appl. No.: 528,973

[22] Filed: Sep. 2, 1983

[51] Int. Cl.[3] ..... D01G 15/40

[52] U.S. Cl. ..... 19/105; 19/204

[58] Field of Search ..... 19/105, 97.5, 64.5, 19/204

[56] References Cited

U.S. PATENT DOCUMENTS

| | | | |
|---|---|---|---|
| 3,482,883 | 12/1969 | Hecker | 406/175 |
| 3,728,759 | 4/1973 | Hergeth | 19/105 |
| 3,896,523 | 7/1975 | Beukert | 19/105 |
| 4,136,911 | 1/1979 | Itusges et al. | 19/105 X |
| 4,176,988 | 12/1979 | Lattmann | 19/105 X |
| 4,219,289 | 8/1980 | Trützschler | 19/105 X |
| 4,387,486 | 6/1983 | Keller et al. | 19/105 |
| 4,394,790 | 7/1983 | Keller et al. | 19/105 |
| 4,404,710 | 9/1983 | Wood | 19/105 |

FOREIGN PATENT DOCUMENTS

| | | | |
|---|---|---|---|
| 2835114 | 3/1979 | Fed. Rep. of Germany | 19/105 |

*Primary Examiner*—Louis K. Rimrodt

*Attorney, Agent, or Firm*—Richards, Shefte & Pinckney

[57] ABSTRACT

A chute feed having a vertically extending chute for collecting and densifying fiber therein, the chute being formed by a plurality of fixed, imperforate walls, and a perforated wall portion mounted adjacent the lower end of the chute for oscillating movement about a horizontal pivot shaft. Pressurized air is forced downwardly through the collected fibers in the chute and is discharged through the perforated wall portion, thereby densifying the fiber. The oscillating movement of the perforated wall portion results in the upper and lower ends thereof being alternately moved toward and away from the collected fiber to alternately compress such fibers and then release such fibers from the holding effect of the air passing through the perforated wall.

5 Claims, 3 Drawing Figures

FIBER FEEDING APPARATUS WITH A PIVOTED AIR EXHAUST WALL PORTION

BACKGROUND OF THE INVENTION

It is well-known in the textile field to utilize fiber feeding apparatus, commonly referred to as chute feeds, for collecting fiber tuffs which are densified or compacted within the chute feed and then fed as a batt to carding machines and the like for further processing. It is also well-known that the quality of the yarn which is ultimately formed by the textile processing operation depends to a large extent on the uniformity of the density of the batt discharged from chute feed, and a number of efforts have been made to improve the uniformity of the batt density by utilizing various means for mechanically or pneumatically compressing the fiber during its movement through the chute.

For example, chute feeds have heretofore been constructed with a vertical fiber collecting chute formed by a plurality of imperforate walls which extend along the entire vertical length of the chute, with one of such imperforate walls being mounted adjacent its upper end for pivotal movement toward and away from an opposite imperforate wall. The pivoted wall is continuously oscillated to impose a mechanical compressive force on the collected fiber in the chute along virtually the entire vertical extent thereof. However, this oscillating movement of the entire chute feed wall has a tendency to permit the collected fiber between the oscillating and fixed walls to expand or open to some extent during movement of the oscillating wall away from the fixed wall, thereby partially reducing the effectiveness of the compaction of the fiber, particularly since the oscillating wall extends along virtually the entire vertical extent of the chute. Examples of chute feeds of this type are disclosed more fully in U.S. Pat. Nos. 3,896,523, and 3,728,759.

Another approach to densifying the fiber in chute feeds has been to utilize an induced air flow to transport fiber tufts to the vertical chute, and to cause the pressurized air to flow downwardly through the collected fibers in the chute to compress such fibers, typical examples of chute feeds of this type being disclosed in greater detail in U.S. Pat. Nos. 3,482,883, and 4,176,988. In some chute feeds of this type, at least one of the fixed walls forming the chute includes a fixed perforated portion adjacent the lower end of the wall through which the air is discharged or exhausted either in a continuous flow-through of the air, as disclosed for example in U.S. Pat. No. 4,136,911, or in a closed path as disclosed for example in U.S. Pat. No. 4,219,289. In either case, it will be apparent that this flow of pressurized air, after passing downwardly through the fibers collected in the chute, must pass through the perforations in lower part of chute wall at a velocity which results in some of collected fibers in the chute being held against the adjacent surface of the perforated wall. This induced holding of the fibers against the surface of the perforated wall portion adversely effects the ability of the collected fiber to move freely down through the chute, and, more importantly, it has an adverse effect on the uniformity at which such fibers will be compacted or densified at the point where maximum compression is normally obtained, namely at the lower end of the chute just prior to the fibers being discharged therefrom. These adverse effects are exacerbated when two opposed, stationary walls of the chute are perforated, as shown for example in the aforesaid U.S. Pat. No. 4,219,289, because the induced holding of the fibers against the perforated wall occurs on two sides of the collected column of fibers.

SUMMARY OF THE INVENTION

In accordance with the present invention, a chute feed is provided which avoids the drawbacks of know chute feeds by utilizing the beneficial effect of both mechanical and pneumatic compression to obtain uniform densification of the collected fiber, while effectively dealing with the problem of fibers being held against the perforated walls of the chute as discussed above.

The chute feed of the present invention includes a vertically extending, fiber collecting chute having an open upper end at which fiber is delivered to the chute, and feed rolls are provided at the bottom end of the chute to discharge the collected fibers therefrom. The chute is formed by a plurality of fixed, imperforate walls, and means are provided for causing pressurized air to flow downwardly through the chute and the fibers collected therein to compress such fibers. A perforated wall portion is disposed in the chute, preferably adjacent the lower end of the chute, to permit the air flow to be discharged through such perforated wall portion, and this perforated wall portion is mounted for periodic movement away from the collected fibers in the chute to an extent that will alleviate the problem caused by fibers from being held against the perforated plate by the air flow therethrough. Thus, in the chute feed of the present invention, densification of the collected fibers is obtained by mechanical compression imposed thereon, preferably at the lower end of the chute where maximum densification of the fibers is desired, and compression is also obtained along the entire column of the collected fibers by the pressurized air flow therethrough, but the aforesaid adverse effects caused by the fibers being held against the perforated wall portion of the chute are effectively dealt with in a manner that significantly improves the uniformity of the density of the fiber batt formed by the chute feed.

In the preferred embodiment of the present invention, the perforated wall portion is disposed just below one of the fixed, imperforate walls of the chute as a continuation thereof, and the perforated wall portion is mounted on a horizontal pivot shaft located above the vertical midpoint of the perforated wall portion so that it can be continuously oscillated by a mechanical drive through a path of movement that is sufficient to result in at least the major surface portions of the perforated wall portion being periodically moved in a direction away from collected fiber in the chute to an extent that will release fibers from being held against the perforated wall portion by the air flow therethrough, whereby such fibers are permitted to be uniformly densified while they move freely through the chute.

DESCRIPTION OF THE PREFERRED EMBODIMENT

Figure 1:
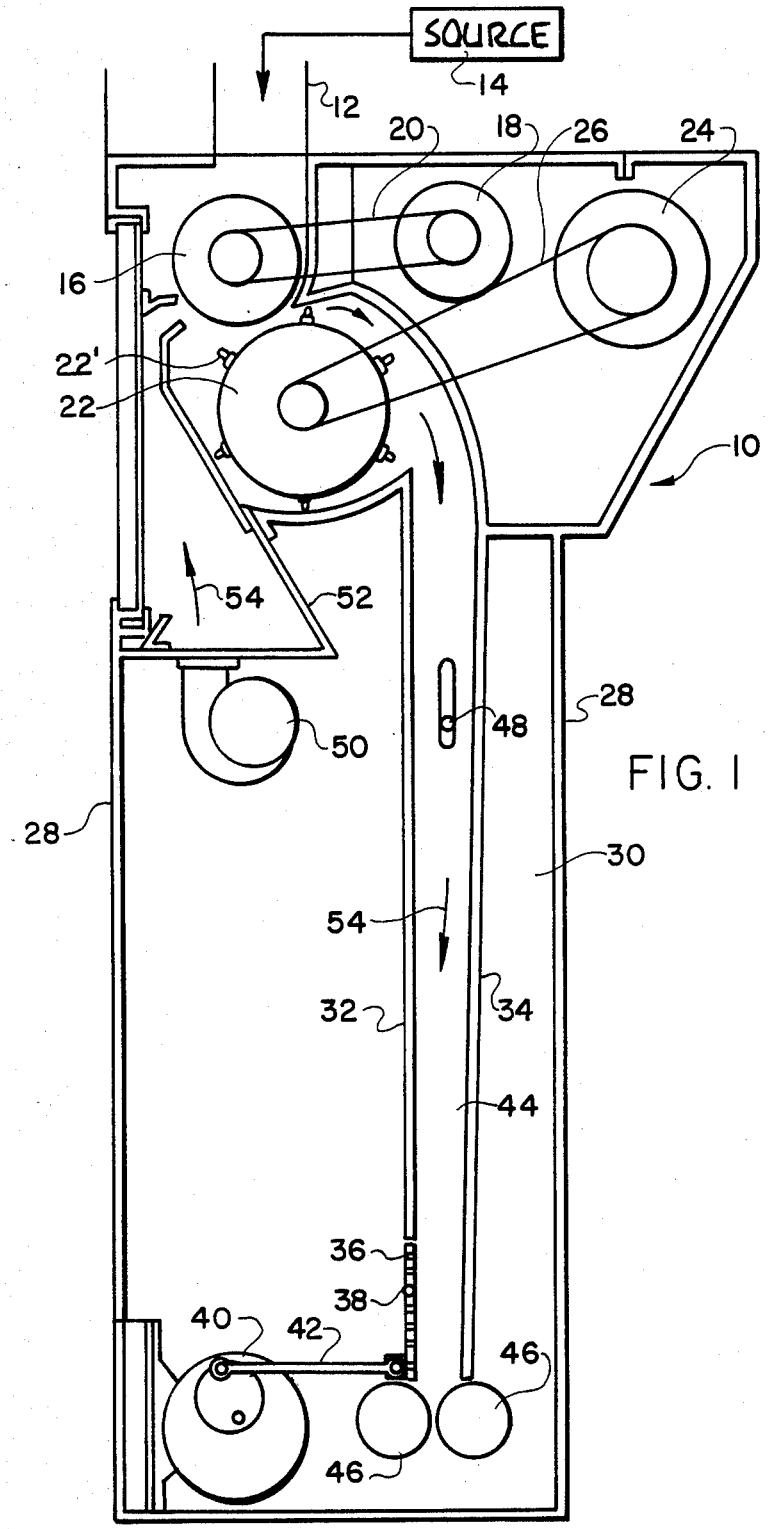
FIG. 1 is a diagrammatic side elevational view of fiber feeding apparatus embodying the present invention.

A fiber feeding apparatus 10 embodying the present invention is illustrated in FIG. 1 disposed beneath an inlet duct 12 through which fiber tufts from any suitable source 14 are delivered conventionally in an air stream that may be exhausted through a conventional perforated plate or opening (not shown) located at the inlet duct 12, whereby a supply of fiber tufts collect in the inlet duct 12 for delivery to the chute feed 10. The chute feed 10 includes a feed roller 16 driven by a motor 18 through a drive 20 to deliver fiber from the inlet duct 12 to an axially extending opening roller 22 rotatably mounted in the chute feed 10 and driven by motor 24 through a drive 26, the opening roller 22 preferably having a plurality of projections 22' extending radially therefrom to open the fiber tufts delivered by the opening roller 22.

The frame 28 of the chute feed 10 includes a pair of opposed side walls 30, only one which is illustrated in FIG. 1, and two imperforate walls 32 and 34 are mounted at fixed positions interiorly of the frame 28 to extend vertically and in spaced relation to one another. The imperforate wall 32 is shorter in length than the imperforate wall 34, and a perforated wall 36 is disposed at the lower end of the wall 32, generally as a continuation of the wall 32. The perforated wall portion 36 is mounted on a horizontal pivot shaft 38 for pivotal or oscillating movement thereabout, and a motor 40 is provided to oscillate the perforated wall portion 36 through an eccentric drive linkage 42, all as will be explained in grater detail presently.

Thus, the fixed, imperforate walls 32, 34, and the perforated, pivoted wall 36, together with the side walls 30, form a substantially enclosed chute 44 that extends vertically, with an open upper end for receiving fiber delivered thereto by the opening roll 22 and with an open bottom end through the collected fibers are discharged from the chute in batt form by drive rolls 46. A photocell 48 is adjustably mounted in one of the side walls 30 for disposition near the upper end of the chute 44 to control the operation of the chute feed 10. When the level of the fiber collected in the chute 44 drops beneath the level of the photocell 48, the photocell 48 generates a signal that operates the motors 18, 24, to selectively drive the feed roll 18 and the opening roll 22 so that more fiber will be delivered to the chute 44, all in a conventional manner known in the art. Finally, in the preferred embodiment of the present invention, an air blower 50 is mounted interiorly of the chute feed 10 on a partition wall 52 that is formed to direct the air flow discharged by the blower 50 in a path that passes upwardly around the opening roller 22, in the direction of rotation thereof, to assist in removing fibers from the opening roller 22, and then downwardly into the open end of the chute 44, this air flow path being indicated by direction arrows 54.

In operation, fibers from the inlet duct 12 are delivered, under the control of photocell 48, by the opening roller 22 to the vertical chute 44 in which the fibers are collected. The pressurized air from the blower 50 is forced downwardly through the collected fibers in the chute 44, and is exhausted through the perforated wall portion 36 at the bottom of the chute 44. As the air is forced downwardly through the collected fibers, it imposes a compressing force on the fibers to densify the fibers, which are then discharged from the chute by the rolls 46 as a batt for delivery to a carding machine or other processing equipment (not shown).

Since the perforated wall portion 36 is preferably disposed adjacent the lower end of the chute, and since the walls 30,32,34 are imperforate, the pressurized air is forced downwardly through the entire column of the collected fiber to exert a compressing force thereon, and the fibers tend to become more and more compressed as they move downwardly through the chute 44, with maximum densification occurring at lower end of the chute 44, which is desirable. However, it will be appreciated that as the pressurized air is forced to pass through the perforated wall 36, the inertia or flow of such air naturally has a tendency to press or hold the adjacent fibers against the interior surface of perforated wall 36 so that such fibers cannot move freely along the perforated plate, thereby adversely affecting the densification of the fibers at the lower end of the chute 44.

Figure 2:
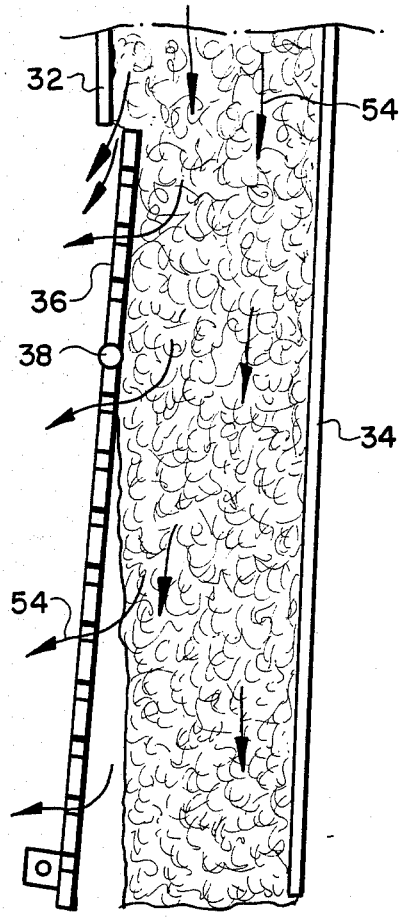
FIGS. 2 and 3 are detail views illustrating in somewhat exaggerated form the movement of the pivoted perforated wall portion of the chute feed shown in FIG. 1.
Figure 3:
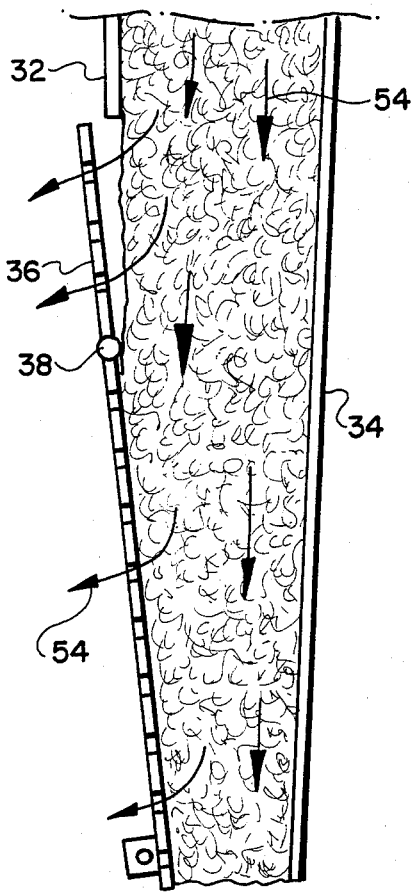

In accordance with the present invention, this problem is significantly alleviated by mounting the perforated wall 36 for periodic movement away from the fibers so that they can be released from the holding effect of the air passing through the perforated wall 36. As best seen in FIGS. 2 and 3, the perforated wall 36 is continuously oscillated or pivoted about the pivot shaft 38 between two positions as illustrated in FIGS. 2 and 3. In FIG. 2, the perforated wall 36 is shown at its position of maximum clockwise movement, and it will be noted that the lower portion of the perforated wall 36 has been moved outwardly from the collected fibers. Since the fibers are generally densified or compressed at the bottom of the chute, they tend to remain in generally a batt form when the perforated wall 36 moves away, so that the fibers and perforated wall 36 become separated as shown, with the air flow passing freely through the perforated wall 36 and with the fibers being released from the holding effect of such air flow so that they can be freely compressed in a uniform manner and move downwardly through the chute 44. Similarly, as shown in FIG. 3, movement of the perforated wall 36 in its counter-clockwise direction releases the fiber from the upper portion of the perforated wall 36 above the pivot shaft 38.

Thus, the constant oscillating movement of the perforated wall 36 results in the upper and lower ends thereof being alternately and continuously separated from the fibers adjacent thereto to release such fibers and effectively overcome the adverse effects, discussed above, which would otherwise be present if the fibers are held against the perforated wall 36. Moreover, while one part of the perforated wall 36 is being moved away from the fibers to release them, the other part of the perforated wall 36 is being moved toward the opposite imperforate wall 34 to compress the fibers therebetween and assist in compressing or densifying such fibers. It has been found through testing that superior results are obtained from the present invention by locating the pivot shaft 38 somewhat above the vertical mid-point of the perforated wall 36, so that the bottom part of the perforated wall 36 is the longer part and can exert greater compressive forces on the fiber at the lowest part of the column of collected fibers, as illustrated in FIG. 3.

In the preferred embodiment of the present invention, the pressurized air for densifying the fibers is generated by a blower 50 which causes the air to move within the chute feed 10 in a closed path. However, it will be appreciated that this pressurized air could be obtained from any convenient source, including utilization of the air flow which transports the fibers to the chute feed 10 from the source 14. Also, in the preferred embodiment of the present invention, the perforated wall portion 36 is disposed adjacent the lower end of the chute 44, but it will be understood that such perforated wall portion 36 could be disposed along at least any portion of the vertical extent of the chute 44.

The present invention has been described in detail above for purposes of illustration only and is not intended to be limited by this description or otherwise to exclude any variation or equivalent arrangement that would be apparent from, or reasonably suggested by the foregoing disclosure to the skill of the art.

I claim:

1. Apparatus for feeding fibers to textile processing equipment such as carding machines and the like, said apparatus including:

(a) a fiber collecting chute formed by generally stationary, imperforate walls extending in a vertical direction;

(b) means for delivering fibers into the upper end of said chute for collection therein;

(c) means for causing a flow of air downwardly through said collected fibers in said chute to compact said collected fibers;

(d) means for discharging said collected and compacted fibers from the lower end of said chute;

(e) a generally vertically extending perforated wall portion disposed along at least a portion of the vertical extent of said chute to permit said flow of air to be discharged therethrough, said perforated wall portion being mounted for alternating pivotal movement about a generally horizontal axis disposed intermediate the vertical extent of said perforated wall portion so that said pivotal movements thereof cause the upper and lower ends of said perforated plate to be alternately and periodically abutted against and separated from the fibers compacted adjacent thereto to release said fibers, and (f) drive means for causing said pivotal movements about said horizontal axis.

2. Apparatus for feeding fibers as defined in claim 1 and further characterized in that said perforated wall portion is disposed adjacent the lower end of said chute.

3. Apparatus for feeding fibers as defined in claim 1 and further characterized in that said perforated wall portion is mounted for pivotal movement about a generally horizontal axis, and in that mechanical drive means are connected to said perforated plate to cause pivotal movement thereof about said axis.

4. Apparatus for feeding fibers as defined in claim 3 and further characterized in that said horizontal axis is disposed above the vertical midpoint of said perforated wall portion.

5. Apparatus for feeding fibers to textile processing equipment such as carding machines and the like, said apparatus including:

(a) a frame;

(b) a plurality of imperforate walls mounted in said frame to extend generally vertically for forming an enclosed fiber collecting chute open at its upper and lower ends;

(c) roller means mounted in said frame for delivering fibers into said open upper end of said chute;

(d) feed roll means disposed adjacent said open lower end of said chute discharging said collected fibers from said chute;

(e) blower means mounted on said frame for generating a flow of air that is directed downwardly through said chute and said fibers collected therein;

(f) a perforated wall portion disposed adjacent the lower end of said chute as a continuation of one of said vertically extending imperforate walls to permit said air flow to be discharged through said perforated wall portion, said perforated wall portion being mounted in said frame on a horizontal pivot shaft disposed intermediate the vertical extend of said perforated wall portion and above the vertical midpoint of said perforated wall portion; and (g) drive means mounted on said frame for causing alternating, periodic pivotal movements of said perforated plate about said pivot shaft, the extent of each of said pivotal movements being sufficient to result in at least the major surface portions of said perforated wall portion being periodically moved in a direction away from the compacted fibers collected in said chute to an extent that will release said fibers from being held against said perforated wall portion by said air flow therethrough so as to permit said fibers to be compacted in said chute and to move freely therethrough.

* * * * *